US009279402B2

(12) United States Patent
Tapin et al.

(10) Patent No.: US 9,279,402 B2
(45) Date of Patent: Mar. 8, 2016

(54) FUEL INJECTOR

(75) Inventors: Christophe Tapin, Saint Sulpice de Pommeray (FR); Stephane Van Den Hende, Marolles (FR); Julien Roussilhe, Blois (FR)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 1099 days.

(21) Appl. No.: 13/382,603

(22) PCT Filed: Jul. 21, 2010

(86) PCT No.: PCT/EP2010/060576

§ 371 (c)(1),
(2), (4) Date: Jan. 6, 2012

(87) PCT Pub. No.: WO2011/012519

PCT Pub. Date: Feb. 3, 2011

(65) Prior Publication Data

US 2012/0097768 A1 Apr. 26, 2012

(30) Foreign Application Priority Data

Jul. 29, 2009 (EP) ..... 09166713

(51) Int. Cl.
*F02M 61/04* (2006.01)
*F02M 55/04* (2006.01)
*F02M 61/16* (2006.01)

(52) U.S. Cl.
CPC ..... *F02M 55/04* (2013.01); *F02M 61/16* (2013.01); *F02M 2200/31* (2013.01); *F02M 2200/315* (2013.01); *F02M 2200/40* (2013.01)

(58) Field of Classification Search
CPC . F02M 55/04; F02M 61/16; F02M 2200/315; F02M 2200/40; F02M 2200/31
USPC ..... 239/533.3, 88–96; 251/48; 123/467
See application file for complete search history.

(56) References Cited

U.S. PATENT DOCUMENTS

| | | | | |
|---|---|---|---|---|
| 4,161,161 | A * | 7/1979 | Bastenhof | 123/447 |
| 2004/0061002 | A1 | 4/2004 | Egler et al. | |
| 2007/0215716 | A1 * | 9/2007 | Cooke | 239/102.2 |

FOREIGN PATENT DOCUMENTS

| | | |
|---|---|---|
| DE | 102004005452 | 8/2005 |
| EP | 1770275 | 4/2007 |
| EP | 1918570 | 5/2008 |
| JP | 10030521 | 2/1998 |
| JP | 2004-52767 | 2/2004 |
| WO | 02090753 | 11/2002 |

OTHER PUBLICATIONS

Russell, David A. "Superposition of Waves", Jul. 25, 1996, http://www.acs.psu.edu/drussell/demos/superposition/superposition.html.*

International Search Report dated Dec. 10, 2010.

English Translation of 1st Japan Office Action dated Jun. 5, 2013.

* cited by examiner

*Primary Examiner* — Arthur O Hall
*Assistant Examiner* — Viet Le
(74) *Attorney, Agent, or Firm* — Thomas N. Twomey

(57) ABSTRACT

A fuel injector for use in an internal combustion engine includes a valve member that is moveable within a bore of an injection nozzle so as to be engageable with a valve seat region to control fuel delivery through one or more nozzle outlets, an injector body housing an actuator that is operable to move the valve member within the bore, and defining an accumulator volume for storing high pressure fuel. The fuel injector includes a damping chamber in fluid communication with the accumulator volume through a fluid passage, the damping chamber serving to reduce pressure wave activity within the accumulator volume.

6 Claims, 2 Drawing Sheets

FUEL INJECTOR

TECHNICAL FIELD

The invention relates to a fuel injector for use in the delivery of fuel to a combustion space of an internal combustion engine. In particular, the invention relates to a fuel injector of the type intended for use in a so-called 'common rail' compression ignition internal combustion engine system.

BACKGROUND OF THE INVENTION

In a known piezoelectrically actuated fuel injector, as disclosed in EP0995901a piezoelectric actuator is operable to control the position of a control piston which is moveable to control the pressure of fuel within a control chamber defined, in part, by a surface associated with a valve needle of the injector. Movement of the control piston to reduce the pressure of fuel within the control chamber causes the valve needle to lift away from a corresponding valve seat region in order to permit fuel to be injected through one or more nozzle outlets. Re-pressurisation of fuel pressure within the control chamber causes the valve member to be moved to re-engage the valve seating region.

A problem exists with the above configuration of fuel injector in that the sudden ejection of fuel through the nozzle outlets, together with movement of the internal injector components such as the piezoelectric actuator and the control piston, causes pressure wave activity within the fuel passages of the injector. The pressure wave activity can affect the quantity of fuel that is delivered through the nozzle outlets so that the actual volume of delivered fuel is not the same as the demanded fuel delivery volume as determined by the electrical driving signal provided to the piezoelectric actuator. Inaccuracy of the actual fuel delivery volume against demanded fuel delivery volume can cause excessive exhaust smoke emissions and increases fuel consumption both of which are undesirable.

It is an object of the invention to provide a fuel injector which does not suffer from the above problem.

SUMMARY OF THE INVENTION

To this end, the invention provides a fuel injector for use in an internal combustion engine, the fuel injector comprising a valve member that is moveable within a nozzle bore so as to be engageable with a valve seat region to control fuel delivery through one or more nozzle outlets, an injector body defining an accumulator volume for storing high pressure fuel, and housing a linear actuator that is operable to move the valve member. The invention is characterised in that the fuel injector includes a damping chamber in fluid communication with the accumulator volume through a fluid passage, the damping chamber serving to reduce pressure wave activity within the accumulator volume.

The invention is particularly applicable to a fuel injector in which the actuator is housed within the accumulator volume, although it should be appreciated that this is not an essential requirement of the invention and it also has utility to fuel injectors where an actuator is located away from the fuel passages within the injector.

In one embodiment where the actuator, preferably a piezoelectric actuator, is housed within the accumulator volume, the injector body may include a control piston coupled to the actuator to modify the pressure of fuel within a control chamber defined, in part, by a surface associated with the valve member such that movement of the valve member is coupled to fuel pressure in the control chamber.

In principle, the damping chamber may be defined in any part of the fuel injector provided that it communicates with the accumulator volume through the fluid passage so pressure waves can oscillate into and out of the chamber. For example, the damping chamber could be a closed volume defined in the nozzle body, or other component, having a single fluid passage in communication with the accumulator volume. However, for convenience of manufacture and space efficiency, it is preferred that the damping chamber is defined by the control piston as this uses the control piston for an additional purpose, thus avoiding the requirement for a specific component.

Conveniently, the damping chamber may be defined by an open-ended bore provided in the control piston, the bore being shaped to receive a free end of the actuator.

In order to 'tune' the damping chamber to be most responsive to the dominant frequency of the pressure wave activity, the dimensions of the damping chamber and the passage may be configured appropriately in accordance with the equation $$F = \frac{A}{2\pi}\sqrt{\frac{S}{VL}}$$

where:

F is the dominant frequency of the pressure wave activity which it is desirable to reduce;

A is the speed of sound in the fluid medium (fuel) at a pressure and temperature associated with an operating condition of the injector;

S is the cross sectional area of the fluid passage of the damping chamber;

V is the volume of the damping chamber; and

L is the length of the fluid passage.

The invention also relates to an internal combustion engine having a fuel injector in accordance with the invention therein.

It will be understood that by the term "nozzle outlets" it is meant the holes (or apertures) through which fuel is injected from the injection nozzle of the fuel injector and into an associated engine cylinder (in use), which may also be referred to as injection holes, spray holes or similar terms known in the art. By "a set of nozzle outlets" it is meant the one or more nozzle outlets through which fuel is injected when a valve needle is disengaged from an associated seating region.

BRIEF DESCRIPTION OF THE DRAWINGS

In order that the invention may be better understood it will now be described by way of example only with reference to the accompanying drawings, in which.

DETAILED DESCRIPTION OF THE INVENTION

Figure 1:
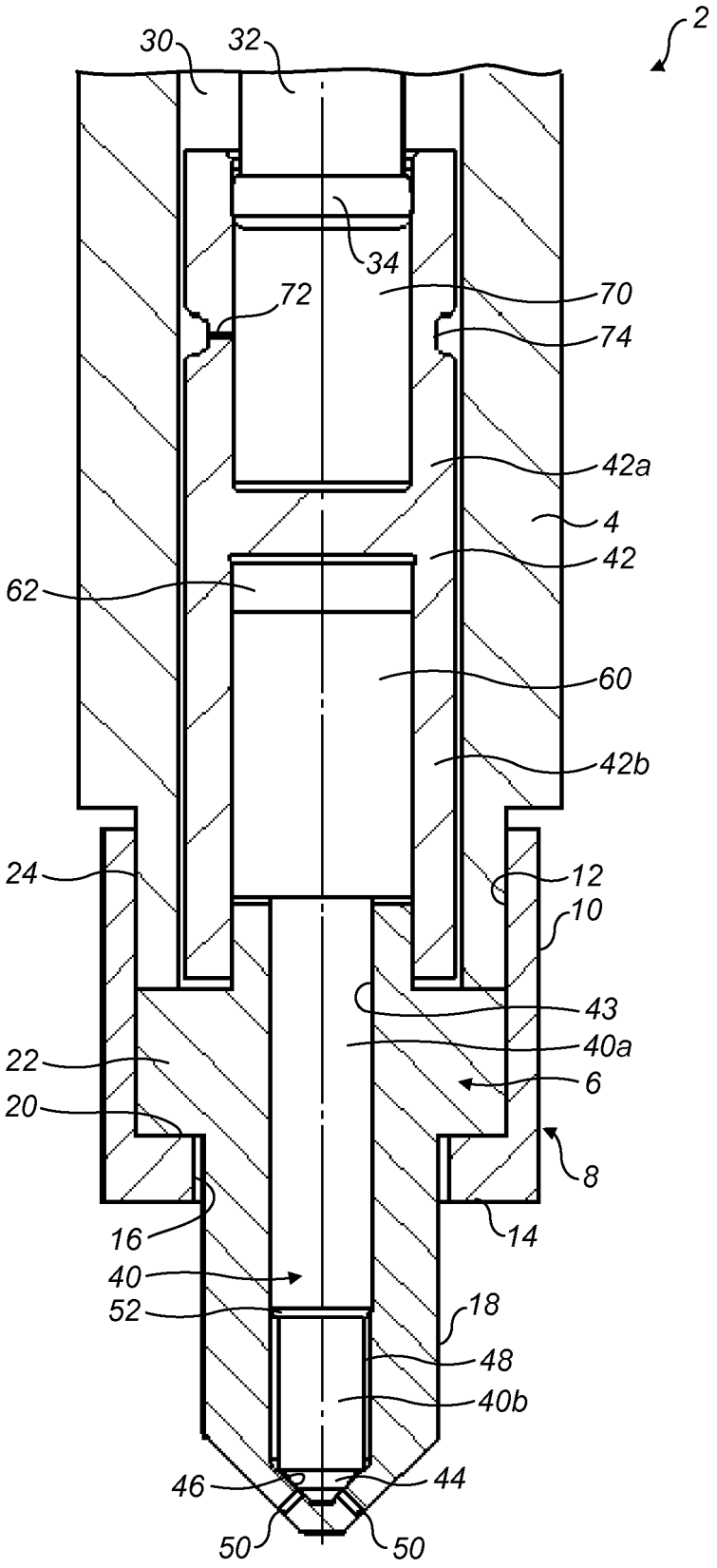
FIG. 1 is a sectioned view of a portion of a fuel injector in accordance with an embodiment of the invention.

Referring to FIG. 1, a fuel injector 2 is generally elongate in form and includes an injector body 4, a lower end of which is attached to an injection nozzle 6. A bucket-shaped cap nut 8 includes a tubular side wall 10 that carries an internal threaded section 12 and a base part 14 which defines a central aperture 16 through which a tip 18 of the injection nozzle 6 extends. A shoulder 20 of the cap nut 8 defined by the aperture 16 bears against a flange portion 22 of the injection nozzle 6 by which means the injection nozzle 6 is secured to the injector body 4 by rotating the cap nut 8 with respect to the injector body 4 so that the threaded section 12 cooperates with a complimentarily threaded section 24 of the injector body 4.

The injector body 4 is generally tubular in form so as to define an internal chamber 30 that constitutes an accumulator volume for storing pressurised fuel and also for housing a linear actuator 32. Internal chamber 30 is hereinafter referred to as accumulator volume 30. Although not shown in FIG. 1, a fuel inlet passage is provided at the upper end of the injector body 4 to supply fuel to the accumulator volume 30 from a source of pressurised fuel, which may be a high pressure fuel pump or a common rail fuel volume of an internal combustion engine system. The upper end of the injector body 4 also includes electrical connections for supplying power to the actuator, but it should be noted that the exact configuration is not essential to the invention. Note that EP0995901 exemplifies a known fuel injector having a fuel inlet connector and electrical power supply connectors provided at its uppermost end.

The actuator 32 takes the form of a stack-type piezoelectric actuator, the general structure of which would be known to the skilled person and is described in EP0995901, the entire contents of which are incorporated herein by reference. The actuator 32 includes an end region 34 that is coupled to a valve member 40 of the injection nozzle 6 by a motion amplifier arrangement, as generally indicated by 42, and as will be described in more detail hereafter.

The valve member 40 is generally needle-shaped and is slidably received within a blind bore 43 provided in the injection nozzle 6. A tip end 44 of the valve member 40 is shaped for engagement with a valve seat region 46 defined adjacent the blind end of the bore 43.

The valve member 40 is of stepped form and includes a relatively large diameter region 40*a* which has a diameter substantially equal to that of the adjacent part of the bore 43 and so is guided for sliding movement within the bore 43. The lower end of the valve member 40 includes a smaller diameter region 40*b* which defines with the bore 43 an annular delivery chamber 48 for fuel around the smaller diameter region 40*b*. Although not shown in the Figures, it should be noted that the injector body 4 and the injection nozzle 6 include fuel passages to convey fuel from the accumulator volume 30 to the delivery chamber 48. Engagement between the tip end 44 of the valve member 40 and the valve seat region 46 controls fluid communication between the delivery chamber 48 and a set of nozzle outlets 50 that are provided in the injection nozzle 6 in a position downstream of the valve seat region 46.

In addition, the valve member 40 defines an angled step 52 at the interconnection of the relatively large region and relatively small diameter regions 40*a* 40*b* which forms a thrust surface on which pressurised fuel within the delivery chamber 48 acts to provide a force on the valve member 40 urging it away from the valve seat region 46. Similarly, the tip end 44 of the valve member 40 provides a further thrust surface via which a further force is applied.

As has been mentioned above, the actuator 32 is coupled to the valve member 40 by way of an amplifier arrangement 42 the primary purpose of which is to convert, or transmit, expansion of the actuator, that is to say axial movement of the end region 34 of the actuator, into axial movement of the valve member. In this embodiment, the amplifier arrangement 42, hereinafter referred to as sleeve 42, is formed from a generally cylindrical sleeve member or piston which is H-shaped in cross section having an upper tubular wall region 42*a* and a lower tubular wall region 42*b* both wall regions defining a respective opening.

The opening of the lower wall region 42*b* of the sleeve 42 receives an enlarged head region 60 of the valve member 40 such that an upper end 60*a* of the head region 60 opposes a base of the lower wall region 42*b* to define a control chamber 62 for fuel. It should be noted that it is not essential for the enlarged head region 60 to be connected to the valve member 40, and it may be a separate component.

At the other end of the sleeve 42, the opening of the upper wall region 42*a* receives the end region 34 of the actuator in a press-fit such that linear movement of the end region 34 due to a change in energisation state of the actuator 32 is coupled mechanically to the sleeve 42.

In use, with the accumulator volume 30 supplied with fuel under high pressure and with the actuator 32 having an energisation state which causes it to adopt an extended position, as shown in FIG. 1, the sleeve 42 occupies a position in which the fuel in the control chamber 62 is pressurised to an extent sufficient to ensure that the force applied to the valve member 40 by pressurised fuel in the control chamber 62 holds the valve member 40 in engagement with the valve seat region 46 against the action of fuel pressure in the delivery chamber 48 acting on the thrust surfaces 52. In this circumstance, fuel injection through the nozzle outlets 50 does not take place. In practice, a spring would be housed within the control chamber 62 to provide an additional closing force to the valve member 40 in order to ensure that the valve member remains seated when the injector is not operating. However, such a spring is not shown here for the purpose of clarity. Also, it should be noted that although not shown in FIG. 1 the sleeve member is provided with a restricted passage to permit pressurised fuel to flow into the control chamber at a restricted rate.

In order to initiate fuel delivery through the nozzle outlets 50, the actuator 32 is operated to a second energisation state (in this case, de-energised) in which its axial length is reduced. Since the upper end of the actuator 32 is held in a fixed position relative to the injector body 4, the change in the energisation state of the actuator 32 to reduce its axial length results in an upward movement of the end region 34 of the actuator 32. The upward movement of the end region 34 is therefore transmitted to the sleeve 42, which lifts by a corresponding amount. This upward movement of the sleeve 42 acts to increase the volume of the control chamber 62 thereby reducing the pressure of fuel therein acting on the valve member 40. The reduction in fuel pressure will continue to a point beyond which the downward force on the valve member 40 is insufficient to keep the valve member 40 in engagement with the valve seat region 46 so the valve member 40 will move axially away from the valve seat region 46 and, as a result, fuel is able to flow from the delivery chamber 48 through the nozzle outlets 50.

To terminate fuel injection, the actuator 32 is returned to its initial energisation state such that the sleeve 42 is pushed in a downward direction returning it to the original position. As a result, fuel pressure within the control chamber 62 increases, applying a greater force to the valve member 40, such that a point is reached beyond which the fuel pressure in the control chamber 62 is able to urge the valve member 40 back into engagement with the valve seat region 46.

It will be appreciated that the fuel injector forms part of an internal combustion engine, in use, and that whilst the engine is operating the fuel injector performs many injection operations every second. When the valve member 40 is lifted away from the valve seat region, the delivery chamber 48 undergoes rapid depressurisation as fuel rushes out of the delivery chamber 48 through the nozzle outlets 50 and into an associated combustion cylinder of the engine. This depressurisation of the delivery chamber 48 causes a negative pressure wave to travel through the fuel passages of the injection nozzle and into the accumulator volume 30 of the injector body 4. The pressure waves are made worse by the rapid movement of the actuator 32 and the sleeve 42.

The pressure wave activity generated by operation of the injector causes the fuel pressure in the delivery chamber to oscillate. Since the quantity of fuel delivered through the nozzle outlets is a function of the time period that the valve member is 'open' and the pressure of fuel, it will be appreciated that the pressure wave activity has a detrimental affect on the fuel delivery accuracy.

In order to attenuate the pressure waves that propagate through the fuel injector, and particularly the accumulator volume, the amplifier arrangement includes a damping chamber 70 that is provided by the closed volume, or chamber, defined between the upper wall region 42*a* of the sleeve 42 and the end portion 34 of the actuator 32. It should be noted at this point that it is not essential that the end portion 34 of the actuator closes the chamber, and other configurations may occur to the skilled person. For example, the chamber could be closed by a ceiling defined by the sleeve, the actuator being secured to the sleeve 42 by another method—for example by a screw thread, or a press fit within a further opening defined by the sleeve 42.

The damping chamber 70 is provided with a fluid passage, or neck, 72 in the form of a single drilling located approximately mid-way along the upper wall region 42*a* such that the damping chamber 70 is in fluid communication with the accumulator volume 30. The neck 72 opens into the accumulator volume 30 at an annular groove 74 provided in the upper wall region 42*a* that provides an unobstructed entrance to the neck 72 and also provides some flexibility to select the length of the neck 72, the purpose of which will be described.

The damping chamber 70 provides a volume in which the pressure waves propagating through the accumulator volume 30 can resonate and reduce over time. Conveniently, the dimensions of the damping chamber 70 are selected so that the chamber is most responsive at damping a certain frequency according to the formula:

$$F = \frac{A}{2\pi}\sqrt{\frac{S}{VL}}$$

where:

F is the frequency that needs to be damped;

A is the speed of sound in the fluid medium (fuel) at a suitable pressure and temperature associated with an operating condition of the injector;

S is the cross sectional area of the neck of the damping chamber;

V is the volume of the damping chamber; and

L is the length of the neck.

Therefore, the volume of the damping chamber 70 and/or the dimensions of the neck 72 are configurable to match the frequency response of the damping chamber 70 to the dominant frequency of the pressure waves.

Figure 2:
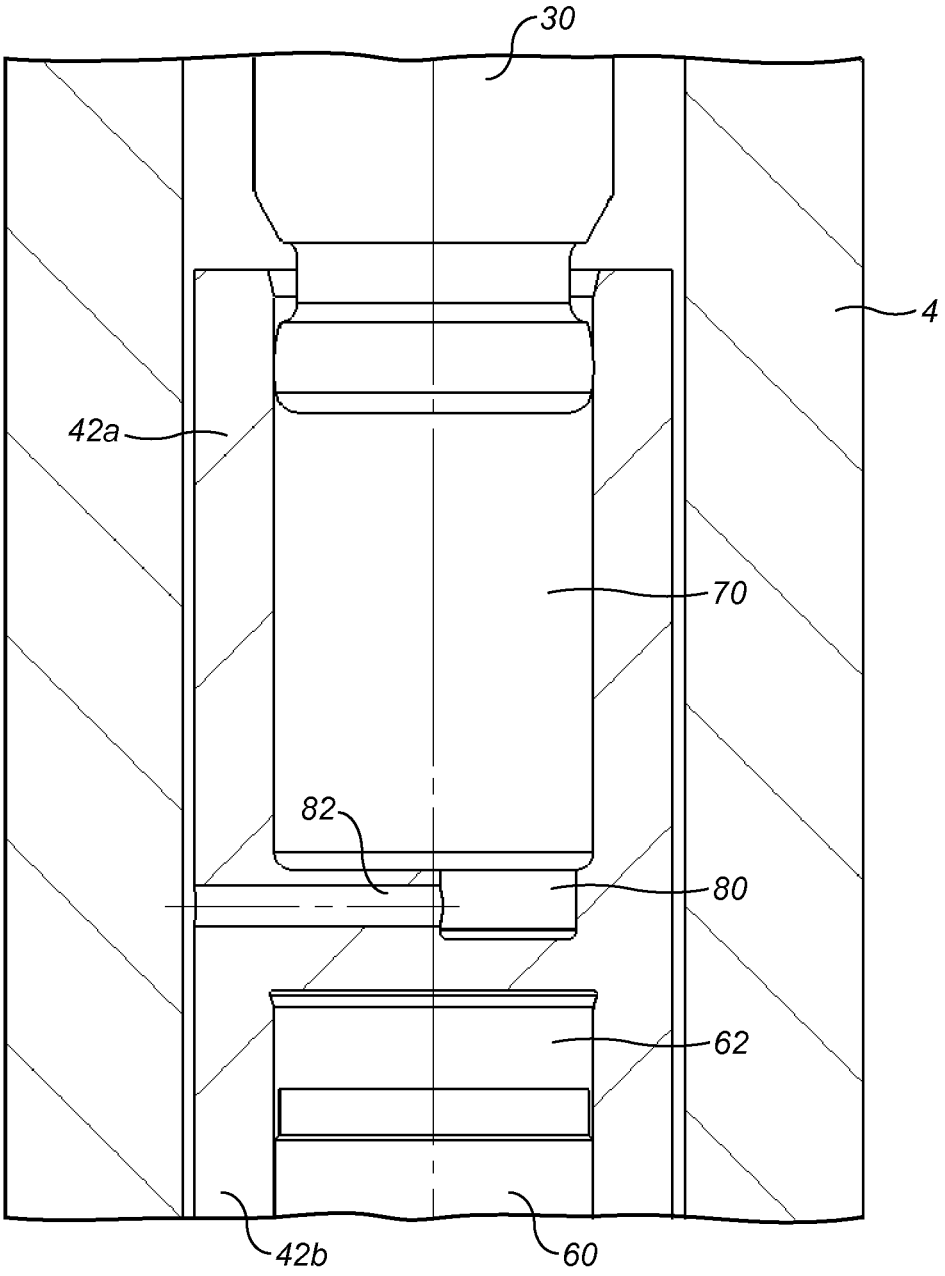
FIG. 2 is an enlarged sectioned view of a fuel injector similar to that in FIG. 1 but which shows a second embodiment of the invention.

It would be apparent to the skilled person that various modifications could be made to the above described embodiment without departing from the inventive concept, as defined by the claims. For example, although the neck 72 is shown in FIG. 1 to extend from approximate mid-way along the length of the damping chamber, this need not be the case. For example, FIG. 2 shows an alternative embodiment in which similar parts to those in FIG. 1 are denoted by the same reference numerals. In FIG. 2, the damping chamber 70 is provided with a relatively small sub-chamber 80 and a neck 82 that extends from the sub-chamber 80 to the outer edge of the sleeve 42. Since the neck 82 in this embodiment extends through a relatively thick walled section of the sleeve 42 from the sub-chamber 80, there is a greater freedom to configure the length of the neck appropriately to fine tune the frequency response of the damping chamber 70. For example, to reduce the length of the neck 82, the sub-chamber 80 can simply be formed in a part of the base closer to the outer edge of the sleeve 42.

In the embodiments of FIGS. 1 and 2, the damping chamber is formed in the sleeve member that couples movement of the actuator to the valve member and it should be noted that this particular configuration provides a space efficient solution to the pressure wave problem since the creation of the chamber does not require additional components to those already part of the actuator. However, the general principle of the invention is applicable to other injector structures: for example if an injector includes a piezoelectric actuator located outside the fluid passage of the injector, the damping chamber could be formed in another component, or in part of the injector body, or in the injection nozzle. However, it is preferable if the neck of the damping chamber is located in close proximity to the injection nozzle since the pressure waves propagate from this region into the fuel passages of the injector body.

It should be mentioned at this point that the accumulator volume in the embodiments of FIGS. 1 and 2 comprises a relatively large volume defined by the injector body that houses the piezoelectric actuator. However, the term 'accumulator volume' also encompasses other fuel passages of injectors, even those which do not house piezoelectric actuators, for example drillings, slots and flutes since it is the combination of the fuel passages and volumes that function together to store pressurised fuel.

Similarly, the presence of a piezoelectric actuator is not essential to the invention and a suitable damping chamber could also be formed in an electromagnetically operated fuel injector.

The invention claimed is:

1. A fuel injector for use in an internal combustion engine, the fuel injector comprising:

a valve member that is moveable within a bore of an injection nozzle so as to be engageable with a valve seat region to control fuel delivery through one or more nozzle outlets, and an injector body defining an accumulator volume for storing high pressure fuel, and housing an actuator that is operable to move the valve member within the bore, wherein the actuator includes an end portion that is coupled to the valve member by a motion amplifier arrangement which includes:

a damping chamber of fixed volume in fluid communication with the accumulator volume through a fluid passage, the damping chamber serving to reduce pressure wave activity within the accumulator volume, and a control piston coupled to the actuator to modify the pressure of fuel within a control chamber defined, in part, by a surface associated with the valve member such that movement of the valve member is coupled to fuel pressure in the control chamber, wherein the damping chamber is defined by a chamber within the control piston.

2. The fuel injector of claim 1, wherein the damping chamber is defined by an open ended wall region provided in the control piston being shaped to receive a free end of the actuator.

3. The fuel injector of claim 1, wherein the damping chamber has a volume that is selected so as to provide the damping chamber with a resonant frequency substantially equal to a dominant frequency of the pressure wave activity within the fuel injector.

4. The fuel injector of claim 1, wherein the fluid passage connecting the damping chamber to the accumulator volume has a length and a diameter, and wherein at least one of the length and the diameter of the fluid passage is selected so as to provide the damping chamber with a resonant frequency substantially equal to a dominant frequency of the pressure wave activity.

5. The fuel injector of claim 1, wherein the actuator is a piezoelectric actuator.

6. A fuel injector for use in an internal combustion engine, the fuel injector comprising:

a valve member that is moveable within a bore of an injection nozzle so as to be engageable with a valve seat region to control fuel delivery through one or more nozzle outlets, an injector body housing an actuator that is operable to move the valve member within the bore, and defining an accumulator volume for storing high pressure fuel, wherein the injector body includes a control piston coupled to the actuator to modify the pressure of fuel within a control chamber defined, in part, by a surface associated with the valve member such that movement of the valve member is coupled to fuel pressure in the control chamber, characterised in that the fuel injector includes a damping chamber of fixed volume in fluid communication with the accumulator volume through a fluid passage, the damping chamber serving to reduce pressure wave activity within the accumulator volume, wherein the damping chamber is defined by an open ended wall region provided in the control piston being shaped to receive a free end of the actuator.

* * * * *